US009572406B2

(12) United States Patent
Tanaka et al.

(10) Patent No.: US 9,572,406 B2
(45) Date of Patent: Feb. 21, 2017

(54) WATERPROOF SLIDE FASTENER

(75) Inventors: Ryo Tanaka, Toyama (JP); Makoto Takayama, Toyama (JP); Masamichi Hasegawa, Toyama (JP); Ryo Mikuma, Toyama (JP)

(73) Assignee: YKK Corporation (JP)

( * ) Notice: Subject to any disclaimer, the term of this patent is extended or adjusted under 35 U.S.C. 154(b) by 128 days.

(21) Appl. No.: 14/375,272

(22) PCT Filed: Jan. 30, 2012

(86) PCT No.: PCT/JP2012/051968

§ 371 (c)(1),
(2), (4) Date: Aug. 4, 2014

(87) PCT Pub. No.: WO2013/114529

PCT Pub. Date: Aug. 8, 2013

(65) Prior Publication Data

US 2015/0000087 A1 Jan. 1, 2015

(51) Int. Cl.

| | |
|---|---|
| ***A44B 19/32*** | (2006.01) |
| ***A44B 19/36*** | (2006.01) |
| ***A44B 19/34*** | (2006.01) |

(52) U.S. Cl.

CPC ..... *A44B 19/32* (2013.01); *A44B 19/34* (2013.01); *A44B 19/36* (2013.01); *Y10T 24/2514* (2015.01)

(58) Field of Classification Search

CPC ..... A44B 19/32; A44B 19/00; A44B 19/02; A44B 19/36; A44B 19/38; Y10T 24/25; Y10T 24/2505; Y10T 24/2514; Y10T 24/2516; Y10T 24/2539

See application file for complete search history.

(56) References Cited

U.S. PATENT DOCUMENTS

| | | | |
|---|---|---|---|
| 4,524,493 | A | 6/1985 | Inamura |
| 7,568,270 | B2 | 8/2009 | Cossutti |

(Continued)

FOREIGN PATENT DOCUMENTS

| | | | |
|---|---|---|---|
| JP | 181209/1983 | | 12/1983 |
| JP | 2007-89898 | A | 4/2007 |

(Continued)

OTHER PUBLICATIONS

International Search Report, PCT Application No. PCT/JP2012/051968, mailed Apr. 17, 2012.

*Primary Examiner* — Robert J Sandy
*Assistant Examiner* — Michael Lee
(74) *Attorney, Agent, or Firm* — Kilpatrick Townsend & Stockton LLP

(57) ABSTRACT

A waterproof slide fastener where first and second through-holes are drilled in a tape side edge portion of a waterproof tape at specific intervals from one another, and first and second halves of a fastener element are integrally connected to each other through first through-holes. A stopper includes a body portion and an extension portion extending from the body portion. First and second halves of the stopper straddle a pair of waterproof tapes and are integrally connected to each other through second through-holes. According to the waterproof slide fastener, a manufacturing step thereof can be simplified, and it is possible to effectively prevent water from entering the waterproof slide fastener even if it receives a lateral pulling force.

8 Claims, 10 Drawing Sheets

(56) References Cited

U.S. PATENT DOCUMENTS

| | | | | |
|---|---|---|---|---|
| 2007/0067969 | A1 | 3/2007 | Kusayama et al. | |
| 2007/0074380 | A1* | 4/2007 | Matsumoto ..... | A44B 19/32<br>24/389 |
| 2007/0226965 | A1 | 10/2007 | Cossutti | |
| 2009/0019675 | A1 | 1/2009 | Peano | |
| 2009/0282665 | A1 | 11/2009 | Cossutti | |
| 2013/0232738 | A1* | 9/2013 | Tominaga ..... | A44B 19/32<br>24/435 |

FOREIGN PATENT DOCUMENTS

| | | | |
|---|---|---|---|
| JP | 2007-215819 | A | 8/2007 |
| JP | 2007-275590 | A | 10/2007 |
| JP | 2008-206986 | A | 9/2008 |
| JP | 2008-284358 | A | 11/2008 |
| WO | 03/037132 | A2 | 5/2003 |
| WO | 2011/077570 | A1 | 6/2011 |

* cited by examiner

WATERPROOF SLIDE FASTENER

This application is a national stage application of PCT/JP2012/051968, which is incorporated herein by reference.

TECHNICAL FIELD

The invention relates to a slide fastener having waterproof property, and more particularly, to a waterproof slide fastener provided with a stopper having a waterproof structure capable of effectively preventing liquid from entering the waterproof slide fastener.

BACKGROUND ART

Conventionally, a slide fastener having waterproof property (waterproof slide fastener, hereinafter) is frequently used for an opening/closing portion or an opening of a wet suit and waterproof pants to prevent liquid such as water from entering the wet suit or the waterproof pants when the opening/closing portion or the opening is closed.

Usually, the waterproof slide fastener includes a pair of left and right fastener stringers having element rows formed on waterproof tapes having waterproof layers, and sliders which can slide along the element rows. The left and right element rows are made to couple with each other to bring opposed side edge portions of the left and right waterproof tapes come into intimate contact with each other, thereby preventing water from entering from a front surface into a back surface of the tape (or from back surface to front surface of tape) from between the left and right waterproof tapes.

In such a waterproof slide fastener, stoppers are often placed on both ends of the element rows, and the stoppers restrict sliding ranges of the sliders. Here, of the stoppers placed on the both ends of the element rows, the one on a side with which the slider comes into contact when the left and right element rows completely open is defined as a first stopper (also called lower stopper), and the other one on a side with which the slider comes into contact when the left and right element rows are completely closed is defined as a second stopper (also called upper stopper).

In the following description, a vertical direction means a length direction of a fastener tape, and the vertical direction is the same as a sliding direction in which the slider slides. Especially, a direction in which the left and right element rows are made to couple with each other and the slider is made to slide to close the slide fastener is defined as an upward direction, and a direction in which the slider is made to slide to separate the left and right fastener elements and open the slide fastener is defined as a downward direction.

A lateral direction means a tape width direction of the fastener tape, and the lateral direction is parallel to a tape surface of the fastener tape and is a direction intersecting with a tape length direction at right angles. A longitudinal direction means a front and back direction of the fastener tape intersecting with the tape surface of the fastener tape at right angles, a direction in which a tab of the slider is placed with respect to the fastener tape is defined as a front direction, and its opposite direction is defined as a rear direction.

A structure of the first stopper (lower stopper) placed on the waterproof slide fastener is disclosed in Japanese Patent Application Laid-Open No. 2007-215819 (Patent Document 1) and Japanese Patent Application Laid-Open No. 2008-206986 (Patent Document 2) for example.

As shown in FIG. 11, a waterproof slide fastener 70 described in Patent Document 1 includes a pair of left and right fastener stringers 71 having a plurality of synthetic resin fastener elements 73 injection molded on tape side edge portions of waterproof tapes 72, a slider (not shown), and first stoppers 74 fixed to lower ends of the left and right fastener stringers 71. The first stoppers 74 define a lower limit position of a sliding range of the slider.

The first stoppers 74 of Patent Document 1 includes sheet members 75 adhered or welded such that the sheet members 75 straddle the left and right waterproof tapes 72, stopper body portions 76 formed on the waterproof tapes 72 and the sheet members 75, and a projecting portion 77 upwardly projecting from the stopper body portions 76.

The sheet member 75 in the first stopper 74 is formed by attaching a thermoplastic elastomer or a synthetic rubber to a surface of woven basic cloth or nonwoven fabric, and the sheet member 75 is made of resin film. The sheet member 75 is adhered to or welded onto a back surface of a tape in a region (space portion) where the fastener element 73 of the waterproof tape 72 is not placed such that the sheet member 75 extends between the left and right waterproof tapes 72. The sheet member 75 includes a wide width portion 75*a* having a wide tape width direction and a narrow width portion 75*b* upwardly extending from the wide width portion 75*a* and having a narrow tape width direction. A tip end edge of the narrow width portion 75*b* is in contact with the fastener element 73.

Each of the stopper body portions 76 is formed into a substantially rectangular parallelepiped shape by injection molding thermoplastic resin having the same material as that of the fastener element 73 onto the waterproof tape 72 and the sheet member 75. The stopper body portion 76 includes a first half (tape front surface side half) placed on a tape front surface side and a second half (tape back surface side half) placed on a tape back surface side. The first half and the second half are integrally connected to each other through a through-hole 78 drilled in the waterproof tape 72 and the sheet member 75.

The projecting portion 77 is placed on the fastener stringer 71 on a side where the fastener element 73 (first element) which is adjacent to the first stopper 74 is not placed such that the projecting portion 77 upwardly projects from an upper surface of the stopper body portion 76. The projecting portion 77 is configured such that it can be inserted into an element guide path of the slider when the slider comes into contact with the stopper body portion 76. Since such a projecting portion 77 is placed, it is possible to reliably carry out a sliding operation of the slider in the vicinity of the stopper body portion 76.

In the waterproof slide fastener 70 of Patent Document 1 having the first stopper 74, since the sheet member 75 is pasted on the region of a space portion where the fastener element 73 is not placed such that the sheet member 75 straddles the left and right fastener tapes, waterproof property for preventing water from entering can be obtained even in the region of the space portion.

As shown in FIGS. 12 and 13, a waterproof slide fastener 80 described in Patent Document 2 includes a pair of left and right fastener stringers 81 in which coil-shaped elements 83 are sewn to tape side edge portions of waterproof tapes 82, a slider (not shown), and a first stopper 84 placed on lower ends of the left and right fastener stringers 81.

In this case, a waterproof layer made of waterproof material such as polyurethane is formed on each of the fastener stringers 81 only on one of tape surfaces (tape front surface) in the fastener tape, and the coil-shaped elements 83 are sewn to the other tape surface (tape back surface) where the waterproof layer of the fastener tape is not formed.

The first stopper 84 of Patent Document 2 includes a stopper body portion 85 with which the slider contacts and stops, a front surface side cover portion 86 placed such that it covers the entire left and right waterproof tapes 82 in a tape width direction on a tape front surface side, an extension portion 87 appearing on a tape back surface side of the waterproof tape 82 and downwardly extending along a tape length direction from the stopper body portion 85, and a back surface side cover portion 88 coating a lower end edge of the waterproof tape 82 with a tape back surface side.

As shown in FIG. 14, the first stopper 84 is formed by cutting and removing portions of opposed tape end edges of the pair of waterproof tapes 82 together with the fastener elements 83 to form a space portion 89, and by injection molding polyurethane to fill the space portion 89.

In this case, the stopper body portion 85 is formed such that it rises from the tape front surface sides and the tape back surface sides of the waterproof tapes 82, and portions of the row of elements 83 are embedded in the stopper body portion 85. The front surface side cover portion 86 is formed such that it covers the entire tape region on a lower side from a position higher than the stopper body portion 85. A lower end of the front surface side cover portion 86 is connected to the back surface side cover portion 88 such that the lower end of the front surface side cover portion 86 wraps a lower end edge of the waterproof tape 82. The extension portion 87 is connected to the front surface side cover portion 86 through the space portion 89 which is formed by cutting and removing the waterproof tape 82, and the extension portion 87 covers a portion of a tape inner side edge portion of the waterproof tape 82 with the tape back surface side.

The waterproof slide fastener 80 of Patent Document 2 is configured by cutting and removing portions of the waterproof tapes 82 and the coil-shaped elements 83 to form the space portion 89 and then by injection molding the first stopper 84. Therefore, it is possible to stably form the first stopper 84 into a predetermined shape without receiving influence of the coil-shaped elements 83.

CITATION LIST PATENT DOCUMENTS

Patent Document 1: Japanese Patent Application Laid-Open No. 2007-215819

Patent Document 2: Japanese Patent Application Laid-Open No. 2008-206986

SUMMARY OF THE INVENTION

Problems to be Solved by the Invention

When the waterproof slide fastener 70 having the first stopper 74 as described in Patent Document 1 is to be manufactured, the waterproof layer is formed on the fastener tape having such a length that a plurality of waterproof slide fasteners 70 can be obtained, thereby configuring the waterproof tapes 72.

Next, regions which continuously form through-holes (not shown) and regions which do not form through-holes are alternately formed on a tape side edge portion of each of the obtained waterproof tapes 72 along a tape length direction with predetermined lengths and then, synthetic resins are injection molded into regions where the through-holes of the waterproof tape 72 are formed, and the fastener elements 73 to which the tape front surface side half and the tape back surface side half are connected through the through-holes are formed. At this time, a region of the waterproof tape 72 in the tape length direction where the fastener element 73 is not formed (i.e., region where through-holes are not formed) is the space portion.

Next, the sheet member 75 is adhered to or welded onto the tape back surface sides of the space portions of the left and right waterproof tapes 72 as described above and thereafter, the through-holes 78 are formed in regions of the first stopper 74 where the stopper body portions 76 are formed. After the through-holes 78 are formed, the stopper body portions 76 and the projecting portion 77 are formed on the waterproof tapes 72 and the sheet members 75 by injection molding. According to this, the waterproof slide fastener 70 having the waterproof structure in which the fastener elements 73 and the first stoppers 74 are placed is obtained.

When the waterproof slide fastener 70 of Patent Document 1 is to be manufactured, a step of forming the through-hole for the fastener element 73 and the through-hole 78 for the first stopper 74 in the waterproof tape 72, and the injection molding step of injection molding the fastener element 73 and the first stopper 74 must alternately and repeatedly be carried out and therefore, there is a problem that the manufacturing step becomes complicated.

Further, according to the waterproof slide fastener 70 of Patent Document 1, the sheet member 75 of the first stopper 74 is pasted only on the tape back surface side. Hence, when a lateral pulling force is applied to the waterproof slide fastener 70 (especially region where first stopper 74 of waterproof slide fastener 70 is formed), a recessed groove is formed between the left and right waterproof tapes 72 of the tape front surface side in the space portion along the tape length direction in some cases.

When the waterproof slide fastener 70 of Patent Document 1 is attached to a product to which the fastener is to be attached (fastener-attached product, hereinafter) such as a wet suit and a waterproof pants, the tape front surface side of the waterproof tape 72 and a back surface side of the fastener-attached product are adhered to or welded onto each other in many cases. In this case, at a lower end of the waterproof slide fastener 70, the tape front surface side of a region (especially region to which sheet member 75 is pasted) where the first stopper 74 which is the space portion is formed is adhered to or welded onto the fastener-attached product.

Hence, when the waterproof slide fastener 70 attached to the fastener-attached product receives the lateral pulling force, when the recessed groove is formed between the left and right waterproof tapes 72 on the tape front surface side in the region where the first stopper 74 is formed as described above, there is a problem that there is concern that water enters the fastener-attached product through the recessed groove. Even when water does not actually enter the fastener-attached product through the groove, since it seems to a user of the waterproof slide fastener 70 that water is allowed to enter the fastener-attached product from the groove, there is a room for improvement in terms of external appearance.

According to the waterproof slide fastener 70 of Patent Document 1, to solve the problem that the recessed groove is formed between the left and right waterproof tapes 72 in the region where the first stopper 74 is formed, it seems to be a good idea to paste the sheet members 75 on both the front surface and back surface of the waterproof tape 72. However, in this case, there are drawbacks that the manufacturing step of the waterproof slide fastener 70 further becomes complicated and manufacturing costs are increased.

On the other hand, the element row of the waterproof slide fastener 80 described in Patent Document 2 does not include a fastener element which is injection molded as in Patent Document 1, but includes the coil-shaped fastener element 83 made of monofilament. According to the first stopper 84 of Patent Document 2, although the entire tape front surface side of the waterproof tape 82 is covered with the front surface side cover portion 86, the extension portion 87 is placed between the left and right waterproof tapes 82 on the tape back surface side, and the fastener tape appears from both the left and right sides of the extension portion 87. Hence, for example, when the region where the first stopper 84 is formed receives a lateral pulling force, a boundary portion between the waterproof tape 82 and the extension portion 87 cracks easily and there is concern that a groove is formed between the waterproof tape 82 and the extension portion 87.

Therefore, in the waterproof slide fastener 80 of Patent Document 2 for example, when the tape back surface side of the waterproof tape 82 is attached to the front surface side of the fastener-attached product, there is concern that water enters the fastener-attached product through the groove formed between the waterproof tape 82 and the extension portion 87 when the waterproof slide fastener 80 receives a lateral pulling force. When the above-described groove is formed in the region where the first stopper 84 is formed, since it seems to a user that water is allowed to enter the fastener-attached product from the groove as in Patent Document 1, there is a room for improvement in terms of external appearance.

Further, in the first stopper 84 of Patent Document 2, since the entire tape front surface side of the waterproof tape 82 is covered with the front surface side cover portion 86, a large amount of synthetic resin is required for forming the first stopper 84, and there are drawbacks that the manufacturing costs are increased and flexibility of the waterproof tape 82 is deteriorated.

The invention has been accomplished in view of the above-described conventional problems, and it is a specific object of the invention to provide a waterproof slide fastener in which a fastener element is injection molded and an element row is formed, capable of simplifying its manufacturing step, capable of preventing water from entering the waterproof slide fastener even if the waterproof slide fastener receives a lateral pulling force, and capable of making water seem not to enter the waterproof slide fastener.

Means for Solving the Problems

To achieve the above object, as a basic configuration, the invention provides a waterproof slide fastener including: a pair of fastener stringers in which a plurality of synthetic resin fastener elements are injection molded on opposed tape side edge portions of a pair of waterproof tapes provided at least one of tape surfaces with a waterproof layer; a slider slidably attached to an element row including the plurality of fastener elements; and a synthetic resin stopper placed on at least one of ends of the element row, in which the fastener elements include a first element half placed on a first tape surface side of the waterproof tape and a second element half placed on a second tape surface side of the waterproof tape, and the first and second element halves are integrally connected to each other through first through-holes which are drilled in the tape side edge portion at predetermined intervals from each other, being characterized in that each of the waterproof tapes includes at least one second through-hole drilled in a forming region of the stopper at the same intervals as those of the first through-holes, the stopper includes a body portion with which the slider comes into contact to stop the slider, and an extension portion extending from the body portion in a direction opposite from the element row along a tape length direction, the body portion and the extension portion are integrally molded each other by injection molding, the body portion and the extension portion include a first half placed on the first tape surface side and a second half placed on the second tape surface side, the body portion and the extension portion are fixed such that the first half and the second half straddle the pair of waterproof tapes, and the first half and the second half are integrally connected to each other through the second through-hole, a thickness dimension of the extension portion is smaller than that of the body portion, the body portion and the extension portion are formed to hold the tape side edge portion of the waterproof tape and the extension portion is formed up to the end edge of the waterproof tape.

In the waterproof slide fastener of the invention, it is preferable that a width dimension of the extension portion on the first tape surface side and the second tape surface side is set smaller than that of the body portion.

Further, it is preferable that outer surfaces of both the side edge portions of the extension portion are formed into curved surfaces so that a thickness dimension of the extension portion is gradually reduced outward in a tape width direction.

Further, it is preferable that a width of the extension portion is gradually increased toward an end edge of the waterproof tape.

In the waterproof slide fastener of the invention, it is preferable that the stopper is fixed to both ends of the element row.

It is preferable that the stopper is placed on an end of the element row on a side where the slider slides such that the element row separates, and a portion of the fastener element is embedded and configured in the body portion. In this case, it is preferable that a recess portion is formed in the body portion of the stopper such that the recess portion is cut from an upper bottom of the body portion in an extending direction of the extension portion.

Further, it is preferable that the stopper is placed on an end of the element row on a side where the slider slides such that the element row closes, the body portion includes a slider insertion portion inserted into an element guide path of the slider, and the slider insertion portion includes a ridge portion which comes into intimate contact with inner surfaces of upper and lower blades of the slider.

Effects of the Invention

In the waterproof slide fastener of the invention, the first through-holes and the second through-holes are formed along tape side edge portions of the waterproof tape at predetermined intervals (attaching pitch) from one another. The first and second halves of the fastener element are connected to each other through the first through-hole, and the first and second halves of each of the stopper body portion and the extension portion of the stopper are connected to each other through the second through-hole.

The waterproof slide fastener of the invention can be manufactured in its manufacturing step by continuously drilling the first and second through-holes in the tape side edge portion of the waterproof tape at predetermined intervals from one another and then, by injection molding the fastener element and the stopper sequentially. Hence, since it is unnecessary to alternately and repeatedly carry out the forming step of the through-holes and the injection molding step of the fastener element or the like as the above-described Patent Document 1 for example, the manufacturing step can be simplified.

In the stopper of the invention, the body portion and the extension portion are integrally molded each other by the injection molding, and the body portion and the extension portion are fixed such that they straddle the pair of waterproof tapes. Further, in each of the waterproof tapes, the body portion and the extension portion are configured such that the first half placed on the first tape surface side and the second half placed on the second tape surface side are integrally connected to each other through the second through-hole.

According to this, the body portion and the extension portion of the stopper are firmly fixed to the first and second tape surfaces (tape front and back surfaces) of each of the waterproof tapes in a state where the body portion and the extension portion straddle the left and right waterproof tapes without forming a gap between the body portion and the extension portion. Hence, even if the stopper portion of the waterproof slide fastener receives a lateral pulling force, a crack or a groove is not formed in the stopper itself or in a boundary between the stopper and the waterproof tape. Therefore, even if the waterproof slide fastener receives a lateral pulling force when the waterproof slide fastener is attached to a fastener-attached product such as a wet suit, it is possible to effectively prevent water from entering the waterproof slide fastener, and water does not seem to enter.

According to the stopper of the invention, the first and second halves are connected to each other through the second through-hole of the waterproof tape, and fixed to the first and second tape surfaces at a periphery of the second through-hole. Hence, fixing strength of the body portion and the extension portion with respect to the waterproof tape is high, and when the waterproof slide fastener receives a lateral pulling force, it is possible to prevent the waterproof tape from being cut or torn from the second through-hole.

In the waterproof slide fastener of the invention, a thickness dimension of the extension portion is set smaller than that of the body portion. According to this, since a step formed between the extension portion of the stopper and the waterproof tape can be made small, touching feeling of the waterproof slide fastener can be enhanced. In adhesion or welding between the waterproof slide fastener and the fastener-attached product, when one end of the waterproof slide fastener in the tape length direction is adhered to or welded onto the fastener-attached product along the tape width direction, it is possible to make it difficult to form a gap between the waterproof slide fastener and the fastener-attached product at a boundary between the extension portion and the waterproof tape. According to this, it is also possible to prevent water from entering the waterproof slide fastener through the gap. Further, by making the extension portion thin, since it is possible to reduce an amount of resin required for forming the stopper, it is possible to suppress the manufacturing costs and to enhance flexibility of the stopper.

In the waterproof slide fastener of the invention, width dimensions of the extension portions on the first tape surface side and the second tape surface side are set smaller than that of the body portion. According to this, in the adhesion or welding between the waterproof slide fastener and the fastener-attached product, when the waterproof tape is adhered to or welded onto the fastener-attached product along the tape length direction, it is possible to prevent the extension portion of the stopper and the fastener-attached product from interfering with each other. Hence, it is possible to smoothly adhere or weld the waterproof slide fastener, and it is possible to prevent a gap from being formed between the adhered or welded waterproof tape and fastener-attached product. Further, by forming the extension portion thin in width, since it is possible to reduce an amount of resin required for forming the stopper, it is possible to suppress the manufacturing costs and to enhance the flexibility of the stopper.

In the waterproof slide fastener of the invention, outer surfaces of both the side edge portions of the extension portion are formed into curved surfaces which are curved such that a thickness dimension of the extension portion is gradually reduced outward in the tape width direction. According to this, when one end of the waterproof slide fastener in the tape length direction is adhered to or welded onto the fastener-attached product along the tape width direction, it becomes more difficult to form a gap between the waterproof slide fastener and the fastener-attached product at the boundary between the extension portion and the waterproof tape. Therefore, it is possible to more effectively prevent water from entering the waterproof slide fastener through the gap.

A width of the extension portion of the stopper of the invention gradually increases toward the tape end edge of the waterproof tape. According to this, it is possible to more smoothly form the outer surfaces of both the side edge portions of the extension portion as the stopper separates from the body portion. Therefore, when the waterproof slide fastener is adhered to or welded onto the fastener-attached product, it becomes more difficult to form a gap between the waterproof slide fastener and the fastener-attached product.

In the invention, the stopper having the above-described configuration is fixed to each of both ends of the element row. According to this, it is possible to stably secure excellent water-tightness at both the ends of the element row.

Especially, the stopper of the invention is placed as a first stopper on an end (generally lower end) of the waterproof slide fastener on a side where the slider slides such that the element row separates. Therefore, it is possible to stably secure excellent water-tightness on the one end side of the waterproof slide fastener. In this case, the body portion of the first stopper is configured in a state where a portion of the fastener element is embedded. According to this, since the first stopper is placed such that it continues from the element row, it is also possible to stably secure the water-tightness between the element row and the first stopper.

Further, in this case, a recess portion is formed in the body portion of the stopper such that the recess portion is cut from an upper bottom of the body portion toward an extending direction of the extension portion. For example, when the stopper is injection molded in a state where a portion of the fastener element is embedded as described above, a fitting recess portion formed in a tip end of the fastener element becomes a gap through which molten resin flows out to an exterior, and there is concern that molten resin leaks. Hence, according to the invention, in a mold for forming the stopper, a projecting portion projects on a predetermined portion of a cavity surface side for preventing molten resin from leaking, and the stopper is injection molded in a state where the gap becomes small or the gap is not formed. According to this, a stopper having a predetermined shape is stably formed, and the recess portion which is cut in as described above is formed in the body portion of the stopper.

The stopper of the invention is placed as a second stopper on an end (generally upper end) of the waterproof slide fastener on a side where the slider slides such that the element row closes. According to this, it is possible to stably secure excellent water-tightness on the other end side of the waterproof slide fastener. In this case, the body portion of the second stopper includes a slider insertion portion which is inserted into an element guide path of the slider, and the slider insertion portion includes a ridge portion which comes into intimate contact with inner surfaces of upper and lower blades of the slider. According to this, when the slider is stopped in a state where it is in contact with the second stopper, it is possible to prevent water from entering the waterproof slide fastener from between the slider and the second stopper, and to stably secure water-tightness on the side of the second stopper.

MODES FOR CARRYING OUT THE INVENTION

Preferred embodiments of the invention will be described in detail with reference to the drawings with specific embodiments. The invention is not limited to later-described embodiments, and the invention can variously be changed only if embodiments have substantially the same configuration and exert the same effects as those of the invention.

In following embodiments, waterproof slide fasteners each having a stopper on both ends of an element row are described, but the invention includes a waterproof slide fastener in which the stopper is placed only on one of the ends of the element row. In the invention, it is only necessary that a fastener element is formed by injection molding synthetic resin, and a shape and a dimension of the fastener element can freely be changed.

First Embodiment

Figure 1:
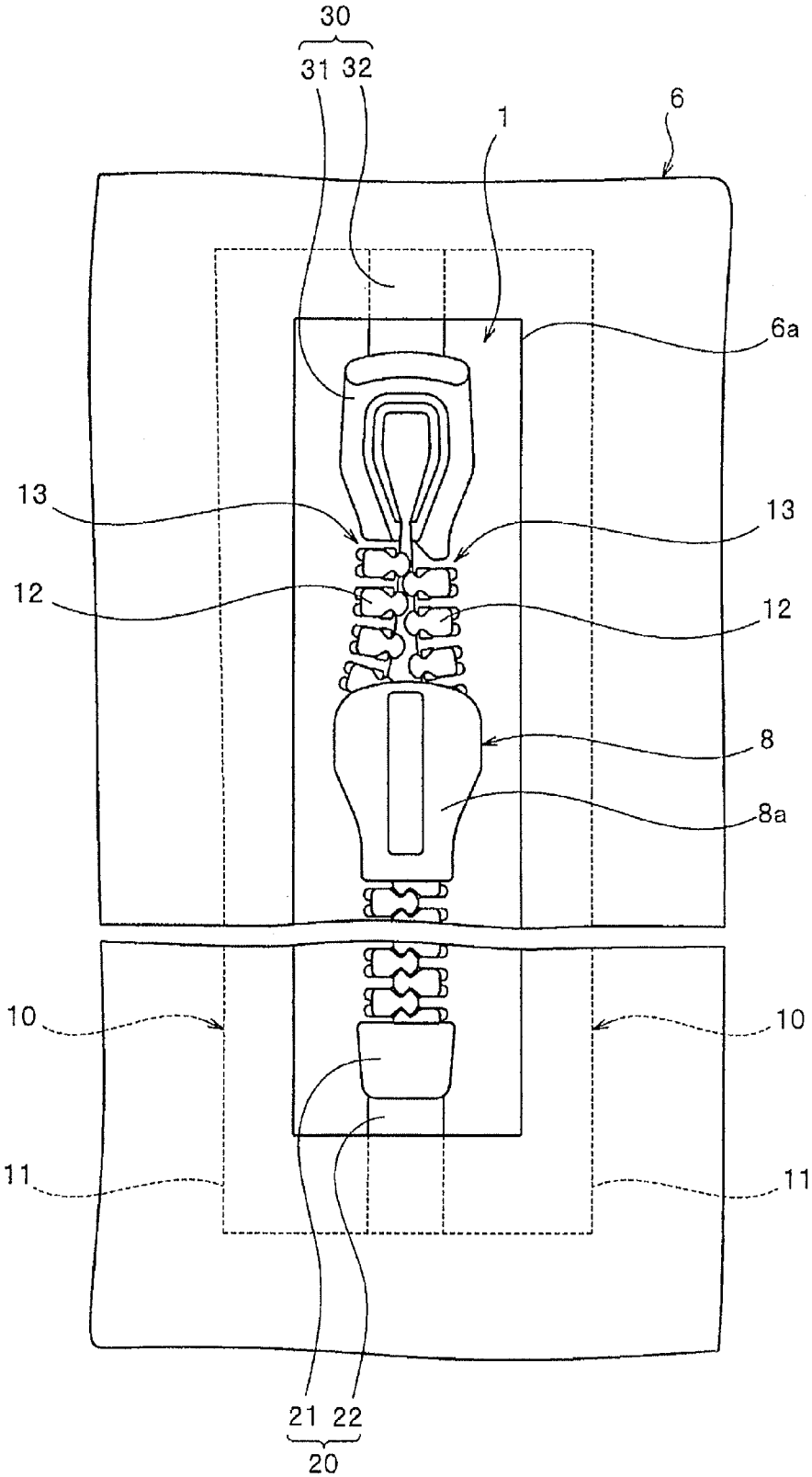
FIG. 1 is a front view showing a waterproof slide fastener according to a first embodiment of the invention.
Figure 2:
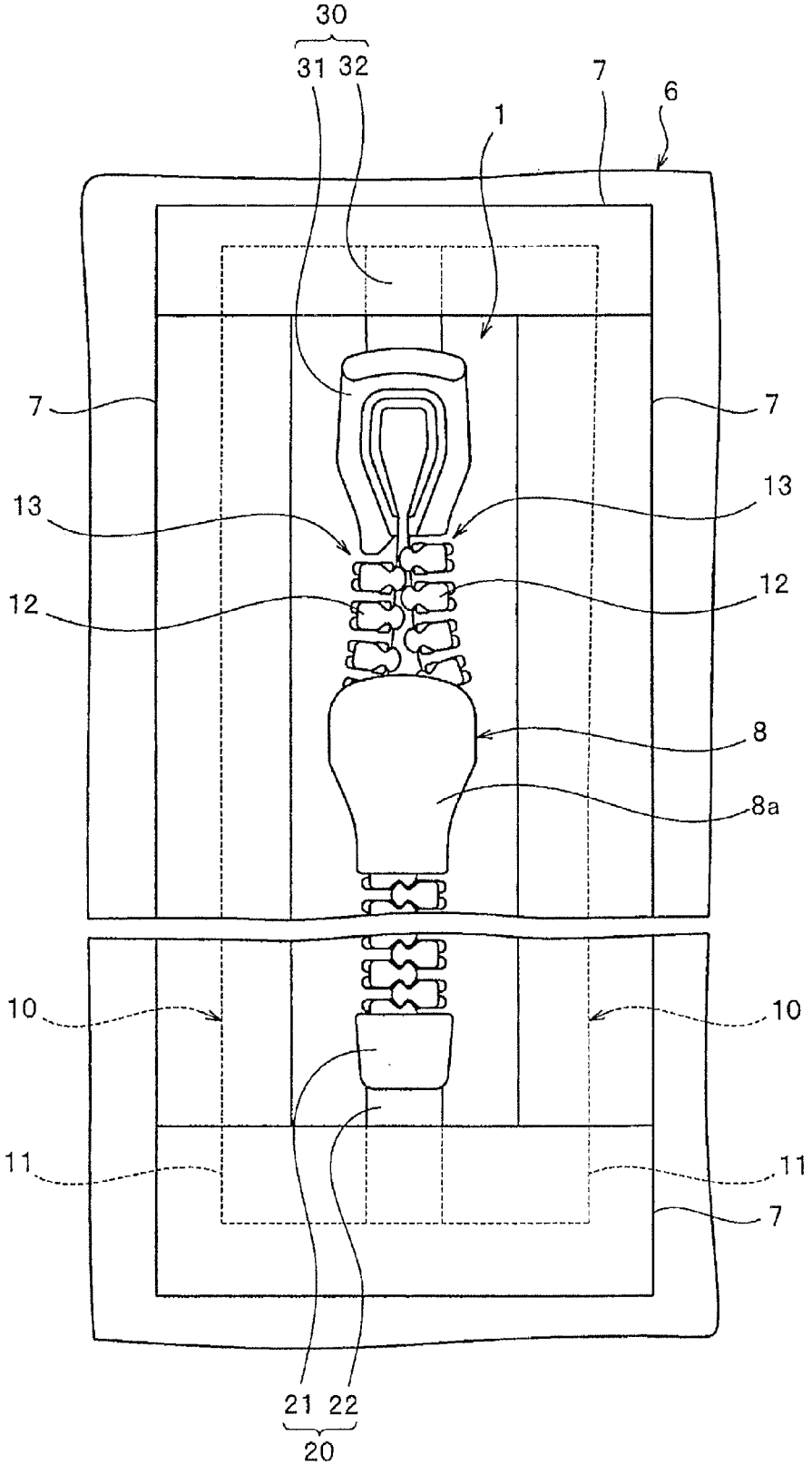
FIG. 2 is a back view of the waterproof slide fastener.
Figure 3:
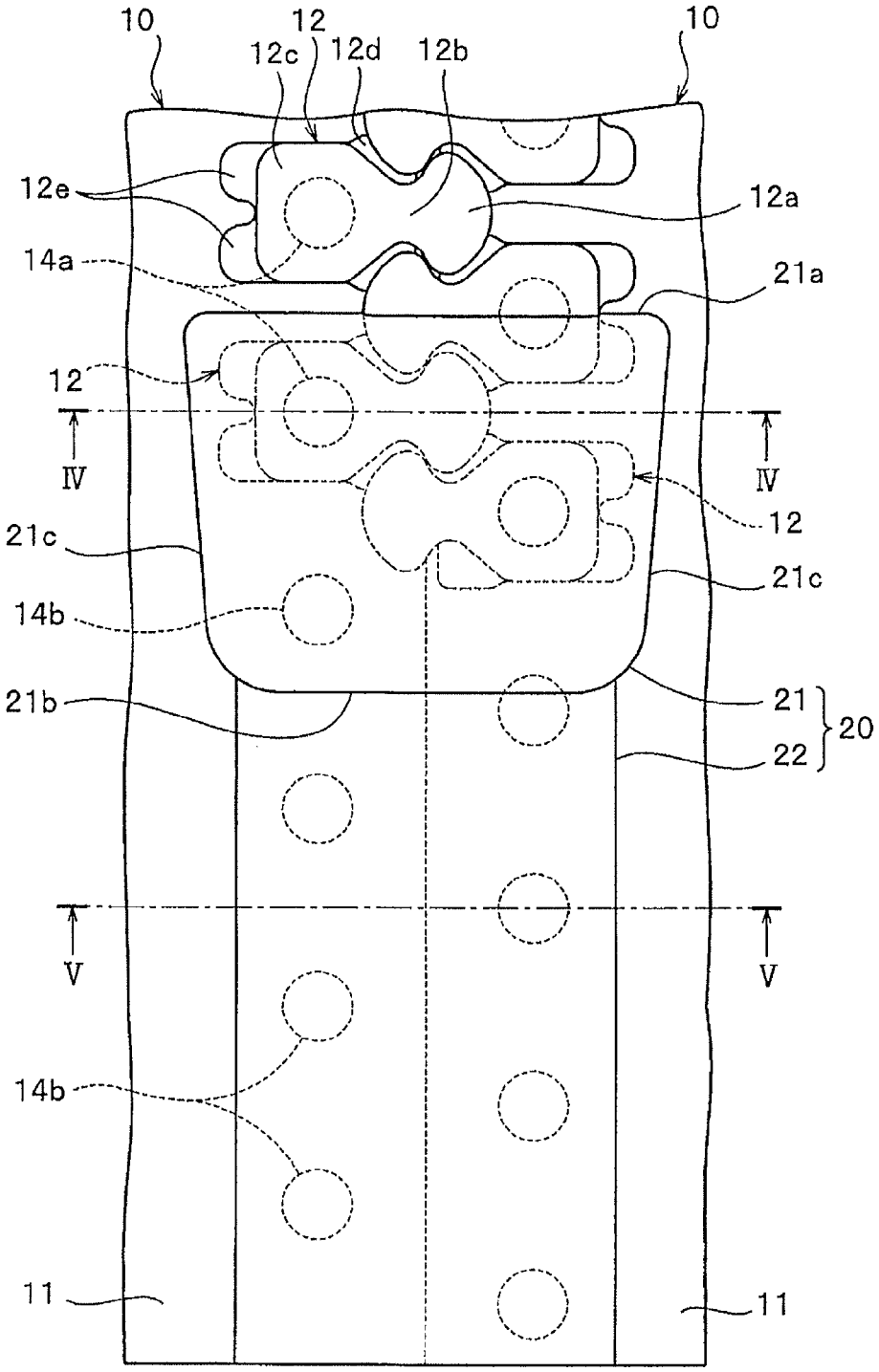
FIG. 3 is an enlarged view of main portions showing a first stopper of the waterproof slide fastener.
Figure 6:
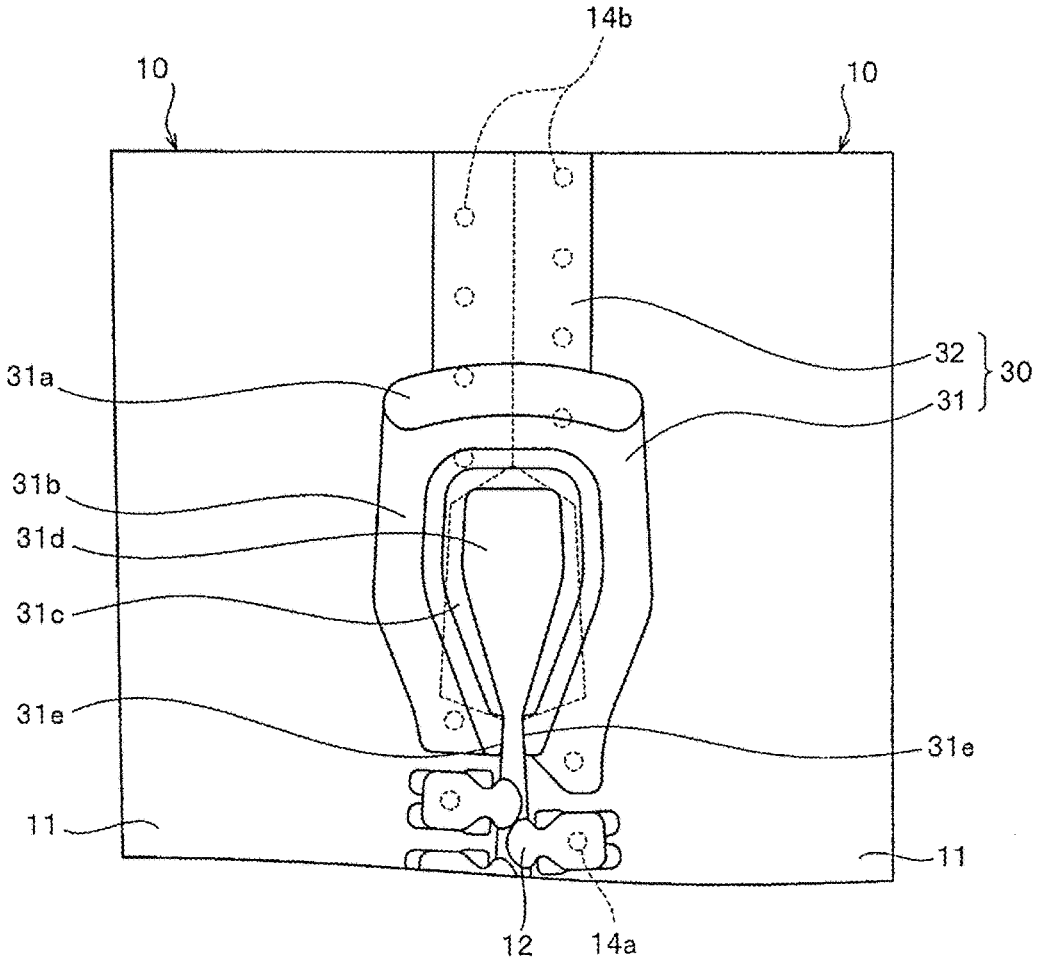
FIG. 6 is an enlarged view of main portions showing a second stopper of the waterproof slide fastener.

FIG. 1 is a front view showing a waterproof slide fastener according to a first embodiment, and FIG. 2 is a back view of the waterproof slide fastener. FIG. 3 is an enlarged view of main portions showing a first stopper of the waterproof slide fastener, and FIG. 6 is an enlarged view of main portions showing a second stopper of the waterproof slide fastener.

As shown in FIG. 1, a waterproof slide fastener 1 according to the first embodiment is attached to an opening/closing portion or an opening 6*a* of a fastener-attached product 6 such as a wet suit. The waterproof slide fastener 1 has such waterproof property that when the waterproof slide fastener 1 is closed, liquid such as water does not leak inside from outside (or from inside to outside) of the fastener-attached product 6 through the waterproof slide fastener 1.

In this case, the waterproof slide fastener 1 is attached to the fastener-attached product 6 by welding, by high-frequency wave, or by adhering, using adhesive, tape front surfaces (first tape surfaces) of later-described left and right waterproof tapes 11 onto or to a back surface side of a peripheral edge of the opening/closing portion of the fastener-attached product 6. Alternatively, it is also possible to sew the waterproof slide fastener 1 and the fastener-attached product 6 to each other by sewing. In the invention, it is also possible to sew the waterproof slide fastener 1 and the fastener-attached product 6 to each other by sewing after the waterproof slide fastener 1 is adhered to or welded onto the fastener-attached product 6.

In the first embodiment, to enhance water-tightness between the waterproof slide fastener 1 and the fastener-attached product 6, waterproof adhesive tapes 7 (also called seam tapes) are adhered to back surface sides of the waterproof slide fastener 1 and the fastener-attached product 6 at upper, lower, left and right four locations such that the adhesive tapes 7 straddle the waterproof tapes 11 and the fastener-attached product 6 as shown in FIG. 2. A hole and a thread formed by sewing may be closed by the adhesive tapes 7.

The waterproof slide fastener 1 of the first embodiment includes a pair of left and right fastener stringers 10 in which a plurality of synthetic resin fastener elements 12 is injection molded to opposed tape side edge portions of the waterproof tapes 11, a slider 8 slidably placed along element rows 13 including the plurality of fastener elements 12, a first stopper (lower stopper) 20 placed on lower end sides of the element rows 13, and a second stopper (upper stopper) 30 placed on upper end sides of the element rows 13.

Figure 4:
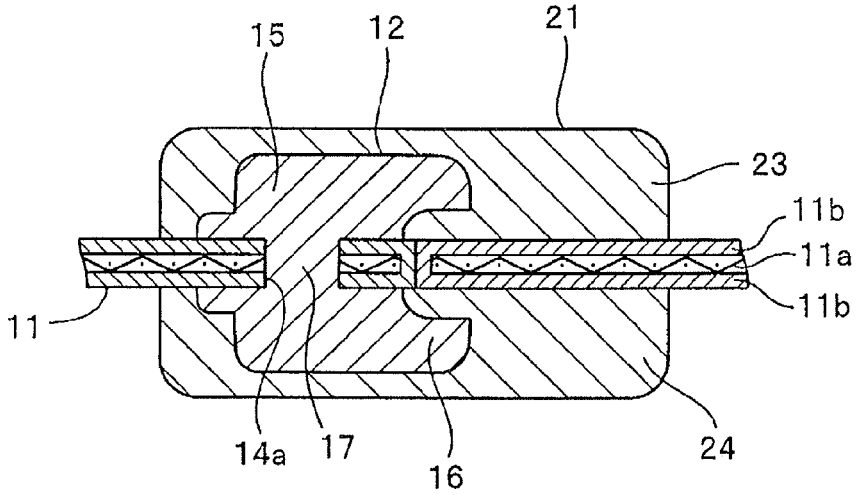
FIG. 4 is a sectional view taken along line IV-IV in FIG. 3.
Figure 5:
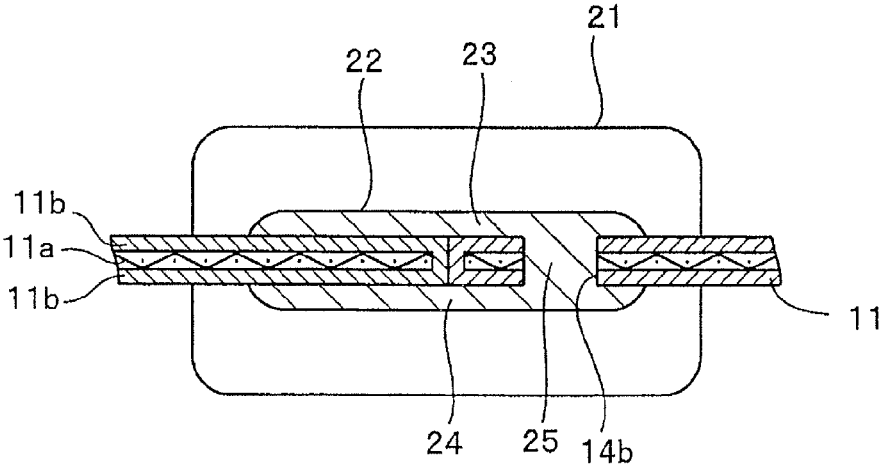
FIG. 5 is a sectional view taken along line V-V in FIG. 3.

As shown in FIGS. 4 and 5, the waterproof tape 11 of each of the fastener stringers 10 in the first embodiment is configured by laminating a waterproof layer 11*b* made of polyurethane-based, polyester-based, polyamide-based or vinyl chloride-based thermoplastic elastomer (one polyester-based thermoplastic elastomer is commercially available as a trade name (Hytrel) provided from DU PONT-TORAY CO., LTD. for example) on a tape front surface (first tape surface) and a tape back surface (second tape surface) of a fastener tape 11*a* which is knitted or woven into a band shape.

Since the waterproof layer 11*b* of the waterproof tape 11 is made of thermoplastic elastomer, it is possible to stably ensure waterproof property, to enhance flexibility of the waterproof tape 11 and to bend the waterproof tape 11 in a tape front and back direction and a tape width direction. Therefore, a handling operation of the waterproof slide fastener 1 becomes easy. When an entire surface of the fastener tape 11*a* is covered with thermoplastic elastomer, it is possible to easily attach the fastener tape 11*a* to the fastener-attached product 6 by high frequency welding.

In the invention, it is also possible to provide the waterproof layer only on one of the tape surface (e.g., tape front surface) of the fastener tape to configure the waterproof tape, and it is also possible to configure the waterproof tape made of only elastomer waterproof layer by extruding and molding thermoplastic elastomer into a sheet shape.

Each of the left and right waterproof tapes 11 includes a tape main body portion to which the fastener-attached product 6 is attached along the tape length direction, and a tape side edge portion (also called element attaching portion) placed on an inner side of the tape main body portion. As shown in FIG. 3, first through-holes 14*a* having sufficiently large holes through which molten resin material can pass in injection molding of the fastener element 12 and second through-holes 14*b* having sufficiently large holes through which molten resin material can pass in injection molding of the first and second stoppers 20 and 30 are continuously drilled in the tape side edge portions of the waterproof tapes 11. In this case, a forming distance between the first through-holes 14*a*, a forming distance between the second through-holes 14*b*, and a forming distance between the first through-hole 14*a* and the second through-hole 14*b* are set equal to each other.

The first through-hole 14*a* and the second through-hole 14*b* are different from each other only in whether the through-hole is provided in a portion where the fastener element 12 (including fastener element 12 embedded in first stopper 20) is formed or the through-hole is provided in a portion where the first and second stoppers 20 and 30 are formed, and shapes, dimensions and formation distances between the first and second through-holes 14*a* and 14*b* are equal to each other. Therefore, in the waterproof tapes 11 before the fastener elements 12 and the first and second stoppers 20 and 30 are formed, there is no distinction between the first and second through-holes 14*a* and 14*b*, and the plurality of through-holes having the same shapes and the same dimensions are drilled at given intervals from one another.

The fastener element 12 of the first embodiment has the same configuration as a fastener element which is placed on a general conventional waterproof slide fastener. More specifically, the fastener element 12 of the first embodiment is formed by injection molding thermoplastic resin such as polyacetal, polyamide, polypropylene, polybutylene terephthalate, nylon and polycarbonate.

The fastener elements 12 includes a long circular coupling head 12*a*, a neck 12*b* which is continuously formed from the coupling head 12*a* and which has a constricted shape, a barrel 12*c* which is continuously formed from the neck 12*b*, a flat-shaped shoulder 12*d* which is vertically extending from the neck 12*b* and the barrel 12*c*, and legs 12*e* which branch and extend from a tape inner side end of the barrel 12*c* through a crotch. Further, a fitting recess portion into which the shoulder 12*d* of the fastener element 12 and a tape side edge portion of the waterproof tape 11 of a coupling mate member are fitted are recessed in a top (tip end) of the coupling head 12*a*.

As shown in FIG. 4, each of the fastener elements 12 includes a first element half (front surface side element half) 15 placed on a tape front surface side and a second element half (back surface side element half) 16 placed on a tape back surface side, and the halves 15 and 16 are placed on both sides of the tape side edge portion of the waterproof tape 11. The first and second element halves 15 and 16 of the fastener element 12 have symmetric shapes with respect to the waterproof tape 11, they are fixed to the waterproof layers 11*b* of the waterproof tape 11, and they are integrally connected to each other through a connecting portion 17 which is formed in the first through-hole 14*a* drilled in the waterproof tape 11.

The slider 8 of the first embodiment is made of synthetic resin or metal, and has the same configuration as that of a slider used for a general conventional waterproof slide fastener. More specifically, the slider 8 of the first embodiment has a stopping mechanism, and includes a slider body 8*a*, a locking pawl body (not shown) attached to the slider body 8*a*, and a tab (not shown) turnably held by the slider body 8*a*.

In this case, the slider body 8*a* includes upper and lower blades, a diamond which connects the upper and lower blades to each other, flange portions placed on left and right side edge portions of the upper and lower blades, and a tab attaching post which stands on an upper surface side of the upper blade. A substantially Y-shaped element guide path is formed between the upper and lower blades. The locking pawl body includes a pawl placed on one end of the locking pawl body, and a biasing portion for making the pawl project into the element guide path. When the tab is not operated, the locking pawl body makes the pawl enter the element guide path to engage the pawl with the fastener element 12. The slider 8 of the invention may not include the locking pawl body.

As shown in FIG. 3, the first stopper 20 (lower stopper) of the first embodiment is placed on a lower end of an element row 13 to define a lower end position of a sliding range of the slider 8. The first stopper 20 is formed by injection molding polyurethane-based, polyester-based, polyamide-based or vinyl chloride-based thermoplastic elastomer. The first stopper 20 includes a first stopper body portion 21 with which the slider 8 comes into contact to stop the first stopper 20, and a first extension portion 22 extending downward from the first stopper body portion 21.

The first stopper body portion 21 and the first extension portion 22 of the first stopper 20 include a first half (front surface side half) 23 placed on the tape front surface side and a second half (back surface side half) 24 placed on the tape back surface side, and the first half 23 and the second half 24 are placed on both sides of the tape side edge portion of the waterproof tape 11.

These first and second halves 23 and 24 straddle the left and right waterproof tapes 11, and have front and back symmetric shapes with respect to the waterproof tapes 11. The first and second halves 23 and 24 of the first stopper body portion 21 and the first extension portion 22 are fixed to the waterproof layers 11*b* of the waterproof tapes 11, and they are integrally connected to each other through a connecting portion 25 formed in the second through-hole 14*b* drilled in the waterproof tape 11.

A thickness dimension in a tape front and back direction of the first stopper body portion 21 is greater than that of the fastener element 12, and has a trapezoidal shape as viewed from front and back. In this case, in the first stopper body portion 21, an upper bottom 21*a* on a side where the slider 8 comes into contact and a lower bottom 21*b* on a side of the first extension portion 22 are substantially parallel to each other, and a length of the lower bottom 21*b* is set shorter than that of the upper bottom 21*a*. Here, the thickness dimension is a dimension in a front and back direction of the fastener tape.

Left and right vertices of the upper bottom 21*a* and left and right vertices of the upper bottom 21*a* [lower bottom 21*b*] are curved as if they are chamfered, and curvatures of the left and right vertices of the upper bottom 21*a* are greater than those of the left and right vertices of the lower bottom 21*b* (curving degrees of vertices of upper bottom 21*a* are stronger than those of vertices of lower bottom 21*b*).

By making the curvatures of the left and right vertices of the upper bottom 21*a* greater in this manner, a longer length of the upper bottom 21*a* (dimension in tape width direction) can be secured. Therefore, it is possible to stably bring the slider 8 into contact with the upper bottom 21*a* of the first stopper body portion 21. By making the curvatures of the left and right vertices of the lower bottom 21*b* smaller, it becomes easy to disperse stress received by the left and right vertices of the lower bottom 21*b* when the waterproof slide fastener 1 is bent along the tape length direction or the tape width direction for example, and it is possible to prevent the lower bottom 21*b* of the first stopper body portion 21 from separating from the waterproof tape 11.

The first stopper body portion 21 is configured by embedding a portion of the element row 13 including the fastener element 12 in a state where the left and right fastener elements 12 are coupled to each other. According to this, since the first stopper body portion 21 is formed continuously with the element row 13, water-tightness between the left and right waterproof tapes 11 between the element row 13 and the first stopper 20 is stably secured.

The first extension portion 22 in the first stopper 20 has a constant dimension (width dimension) in the tape width direction along the tape length direction from the first stopper body portion 21 to a lower end edge of the waterproof tape 11.

In this case, the first extension portion 22 extends from the left and right curved vertices (curved portions) placed on the side of the lower bottom 21*b* of the first stopper body portion 21, and a width dimension of the first extension portion 22 is set smaller than a distance (width dimension of first stopper body portion 21) between left and right sides 21*c* of the first stopper body portion 21.

According to this, when the waterproof slide fastener 1 is attached to the fastener-attached product 6 of a wet suit or the like, if a position of an inner peripheral edge of the fastener-attached product 6 along the tape length direction is set at a position on a more outward side than the first stopper body portion 21 and at a position where no influence is exerted on sliding motion of the slider 8, it is possible to prevent the fastener-attached product 6 and the first extension portion 22 of the first stopper 20 from interfering with each other, and to stably attach the waterproof slide fastener 1.

Dimensions (thickness dimensions) of the first and second halves 23 and 24 of the first extension portion 22 in the tape front and back direction are set smaller than thickness dimensions of the first and second halves 23 and 24 of the first stopper body portion 21. Further, thickness dimensions of the first and second halves 23 and 24 of the first extension portion 22 are set to constant values except later-described left and right curved side edge portions of the first extension portion 22.

Since the first extension portion 22 has the above-described thickness dimension, flexibility of the first extension portion 22 is enhanced, and a difference in level formed between the first extension portion 22 and the waterproof tape 11 can be made smaller. Therefore, touching feeling of the waterproof slide fastener 1 can be enhanced. Furthermore, since the difference in level between the first extension portion 22 and the waterproof tape 11 becomes small, when the lower end of the waterproof slide fastener 1 is attached to the fastener-attached product 6, the fastener-attached product 6 can easily be made to extend along front surfaces of the waterproof tape 11 and the first extension portion 22. Therefore, a gap is less prone to be formed between the waterproof slide fastener 1 and the fastener-attached product 6, and it is possible to prevent water from entering the waterproof slide fastener through the gap.

As shown in FIG. 5, outer surfaces (front and back surfaces) of left and right side edge portions (side edges in tape width direction) of the first and second halves 23 and 24 of the first extension portion 22 are curved and formed into curved surfaces so that a thickness dimension of the first extension portion 22 is gradually reduced outward of the tape width direction (outward from center where left and right waterproof tapes 11 come into intimate contact with each other). According to this, touching feeling of the first extension portion 22 is further enhanced, and when the lower end of the waterproof slide fastener 1 is attached to the fastener-attached product 6, a gap is less prone to be formed between the waterproof slide fastener 1 and the fastener-attached product 6. Shapes of the curved surfaces are not limited only if the thickness dimension of the first extension portion 22 is gradually reduced outward.

As shown in FIG. 6, the second stopper 30 (upper stopper) of the first embodiment is placed on the upper end of the element row 13 to define the upper end position of the sliding range of the slider 8, and the second stopper 30 is formed by injection molding the same material as that of the first stopper 20. The second stopper 30 includes a second stopper body portion 31 with which the slider 8 comes into contact to stop the slider 8, and a second extension portion 32 extending upward from the second stopper body portion 31.

The second stopper body portion 31 and the second extension portion 32 of the second stopper 30 include a first half (front surface side half) placed on the tape front surface side, and a second half (back surface side half) placed on the tape back surface side, the first and second halves straddle the left and right waterproof tapes 11, and have front and back symmetric shapes with respect to the waterproof tapes 11. The first and second halves of the second stopper body portion 31 and the second extension portion 32 are fixed to the waterproof layers 11*b* of the waterproof tapes 11, and are integrally connected to each other through a connecting portion drilled in the second through-hole 14*b* formed in the waterproof tape 11.

The second stopper body portion 31 includes a slider contacting portion 31*a* placed on an upper end of the second stopper body portion 31 and with which upper and lower blades of the slider 8 come into contact, and a slider insertion portion 31*b* extending downward from the slider contacting portion 31*a* and inserted into the element guide path of the slider 8. The slider insertion portion 31*b* includes a ridge portion 31*c* projecting from an inner peripheral edge of the slider insertion portion 31*b* in a tape front and back direction.

The slider contacting portion 31*a* straddles the left and right waterproof tapes 11, has a thickness dimension greater than that of the fastener element 12, and has a shape which is curved as viewed from front such that the slider contacting portion 31*a* extends along shoulder side outer edges of the upper and lower blades of the slider 8.

A thickness dimension of the slider insertion portion 31*b* is smaller than that of the slider contacting portion 31*a* in the tape front and back direction so that the slider insertion portion 31*b* can be inserted into the element guide path of the slider 8, and the slider insertion portion 31*b* has a substantially C-shape as viewed from front. An accommodating portion 31*d* is formed on an inner peripheral side of the slider insertion portion 31*b*, and the diamond of the slider 8 can be accommodated in the accommodating portion 31*d* when the slider 8 is brought into contact with the slider contacting portion 31*a*.

Further, when the slider 8 comes into contact with the slider contacting portion 31*a*, at least a portion of an outer peripheral side surface of the slider insertion portion 31*b* is made to come into contact with the flange portion of the slider 8, and tip ends 31*e* of the left and right element rows 13 in the slider insertion portion 31*b* are brought into intimate contact with each other.

The ridge portion 31*c* of the second stopper body portion 31 is placed along an inner peripheral edge of the slider insertion portion 31*b*, and the ridge portion 31*c* has such a thickness dimension that the ridge portion 31*c* is in intimate contact with inner surfaces of the upper and lower blades of the slider 8 when the slider 8 comes into contact with the slider contacting portion 31*a*.

Therefore, when the slider 8 which slides in a coupling direction of the element row 13 is brought into contact with the slider contacting portion 31*a* to stop the slider 8, the second stopper body portion 31 having the above-described configuration is brought into intimate contact with inner surfaces of the upper and lower blades of the slider 8 to surround the diamond of the slider 8 of the ridge portion 31*c* and the left and right tip ends 31*e* of the slider insertion portion 31*b* are brought into intimate contact with each other. According to this, water-tightness is secured between the second stopper body portion 31 and the slider 8. In the invention, the slider insertion portion 31*b* may not have the ridge portion 31*c*. In this case, the front and back surfaces of the slider insertion portion 31*b* may be brought into intimate contact with the upper and lower blades of the slider 8.

The second extension portion 32 of the second stopper 30 has a constant width dimension along the tape length direction from the second stopper body portion 31 to an upper end edge of the waterproof tape 11. In this case, the width dimension of the second extension portion 32 is set smaller than that of the slider contacting portion 31*a* of the second stopper body portion 31. According to this, when the waterproof slide fastener 1 is attached to the fastener-attached product 6, it is possible to prevent the fastener-attached product 6 and the second extension portion 32 from interfering with each other, and to stably attach the waterproof slide fastener 1.

Thickness dimensions of the of the first and second halves of the second extension portion 32 are set smaller than those of the first and second halves of the slider contacting portion 31*a*, and are set into constant values except later-described left and right curved side edge portions. According to this, flexibility of the second extension portion 32 is enhanced, and a difference in level between the second extension portion 32 and the waterproof tape 11 can be made small.

Like the first extension portion 22 of the first stopper 20, outer surfaces (front and back surfaces) of the left and right side edge portions of the first and second halves of the second extension portion 32 are curved so that a thickness dimension of the second extension portion 32 is gradually reduced outward in the tape width direction.

Next, a manufacturing method of the waterproof fastener of the first embodiment will be described.

First, each of the waterproof tapes 11 is prepared. More specifically, the fastener tape 11*a* is knitted or woven, and films made of thermoplastic elastomer are superposed on both front and back surfaces of the obtained fastener tape 11*a*. In this state, the fastener tape 11*a* and the films are supplied to between a pair of heated rollers, and the films superposed on the front and back surfaces of the tape are welded onto the fastener tape 11*a*. According to this, the waterproof tape 11 having the waterproof layer 11*b* on the tape front surface and the tape back surface is obtained.

Subsequently, a plurality of circular holes having predetermined dimensions is drilled in the tape side edge portion of the obtained waterproof tape 11 at predetermined intervals from one another along the tape length direction. At this time, the formed circular holes become the first through-holes 14*a* placed at forming locations of the fastener elements 12 and the second through-holes 14*b* placed at forming portions of the first and second stoppers 20 and 30. Further, a portion of the waterproof tape 11 where the circular hole is formed is notched to form a notch at a portion of the waterproof tape 11 where the second stopper 30 is formed, so that the accommodating portion 31*d* of the second stopper 30 can be formed.

Obtained two of the waterproof tapes 11 are combined as one set, and thermoplastic resin material is injection molded onto the tape side edge portions of the waterproof tapes 11, thereby forming a plurality of fastener elements 12. At this time, the fastener elements 12 are fixed to positions of the circular holes (first through-holes 14*a*) drilled in the tape side edge portions of the waterproof tapes 11. According to this, a pair of left and right fastener stringers 10 having element rows 13 is configured.

Next, the sliders 8 are attached to the element rows 13 of the pair of left and right fastener stringers 10 and then, thermoplastic elastomer is injection molded onto the upper and lower ends of the fastener stringers 10, thereby forming the first stopper 20 and the second stopper 30. At this time, the first stopper 20 and the second stopper 30 are formed such that the circular holes (second through-holes 14*b*) where the fastener elements 12 are not formed are covered. The first stopper 20 is formed such that a lower end of the element row 13 is embedded.

According to this, the first extension portion 22 and the second extension portion 32 of the first stopper 20 and the second stopper 30 are formed up to the upper and lower ends of the waterproof tape 11. The waterproof tapes 11 at locations having the first stopper 20 and the second stopper 30 have the circular holes (second through-holes 14*b*) into which the connecting portions 25 of the first stopper 20 and the second stopper 30 are inserted.

By carrying out the above-described steps, the waterproof slide fastener 1 of the first embodiment as shown in FIGS. 1 and 2 is manufactured. In the invention, it is also possible to separately carry out the forming steps of the first and second stoppers 20 and 30. When a long fastener chain is formed for example and the long fastener chain is cut to manufacture a plurality of waterproof slide fasteners 1 are manufactured, if the first and second stoppers 20 and 30 placed on adjacent waterproof slide fasteners 1 are simultaneously formed, it is also possible to form the respective first and second stoppers 20 and 30 and the respective first and second extension portions 22 and 32 by integrally forming the first extension portion 22 of the first stopper 20 and the second extension portion 32 of the second stopper 30 and then by cutting the first extension portion 22 and the second extension portion 32 in the tape width direction between the first stopper body portion 21 and the second stopper body portion 31. Timing and means for attaching the sliders 8 to the left and right element rows 13 are not especially limited.

According to such a manufacturing step of the waterproof slide fastener 1, it is possible to continuously form the first and second through-holes 14*a* and 14*b* by one simple stamping operation of a tape. Hence, as compared with the manufacturing step of the waterproof slide fastener 1 in which a sheet member is pasted on the fastener tape 11*a* as in Patent Document 1, it is possible to simplify the manufacturing step of the waterproof slide fastener 1, and to enhance the productivity of the waterproof slide fastener 1.

According to the waterproof slide fastener 1 of the first embodiment, the first and second stoppers 20 and 30 straddle the left and right waterproof tapes 11, and the first and second halves 23 and 24 of the respective stoppers are firmly fixed to the respective waterproof tapes 11 in the state where the first and second halves 23 and 24 are connected to each other through the second through-hole 14*b* of the waterproof tape 11.

Therefore, in the regions where the first and second stoppers 20 and 30 are formed, it is possible to reliably prevent water from entering the tape back surface side from the tape front surface side (or entering tape front surface side from tape back surface side) from between the left and right waterproof tapes 11. Further, water does not enter the waterproof slide fastener from the second through-hole 14*b* drilled in the waterproof tape 11.

Further, even if the waterproof slide fastener 1 receives a lateral pulling force which pulls the waterproof slide fastener 1 to separate in the tape width direction, since a groove or a crack is not generated in a boundary between the first and second stoppers 20 and 30 and the left and right waterproof tapes 11, it is possible to stably prevent water from entering the waterproof slide fastener or it does not seem in appearance that water enters the waterproof slide fastener.

Further, since the first and second stoppers 20 and 30 of the first embodiment are fixed to the front and back surfaces of the waterproof tape 11 at the periphery of the second through-hole 14*b*, the fixing strength with respect to the waterproof tape 11 is high, and when the waterproof slide fastener 1 receives a lateral pulling force, it is possible to prevent the waterproof tape 11 from being cut from the second through-hole 14*b*.

Although the second through-holes 14*b* are formed in both the forming region of the first stopper 20 and the forming region of the second stopper 30 in the first embodiment, the second through-hole 14*b* may be formed only in one of the forming regions of the first and second stoppers 20 and 30.

Second Embodiment

Figure 7:
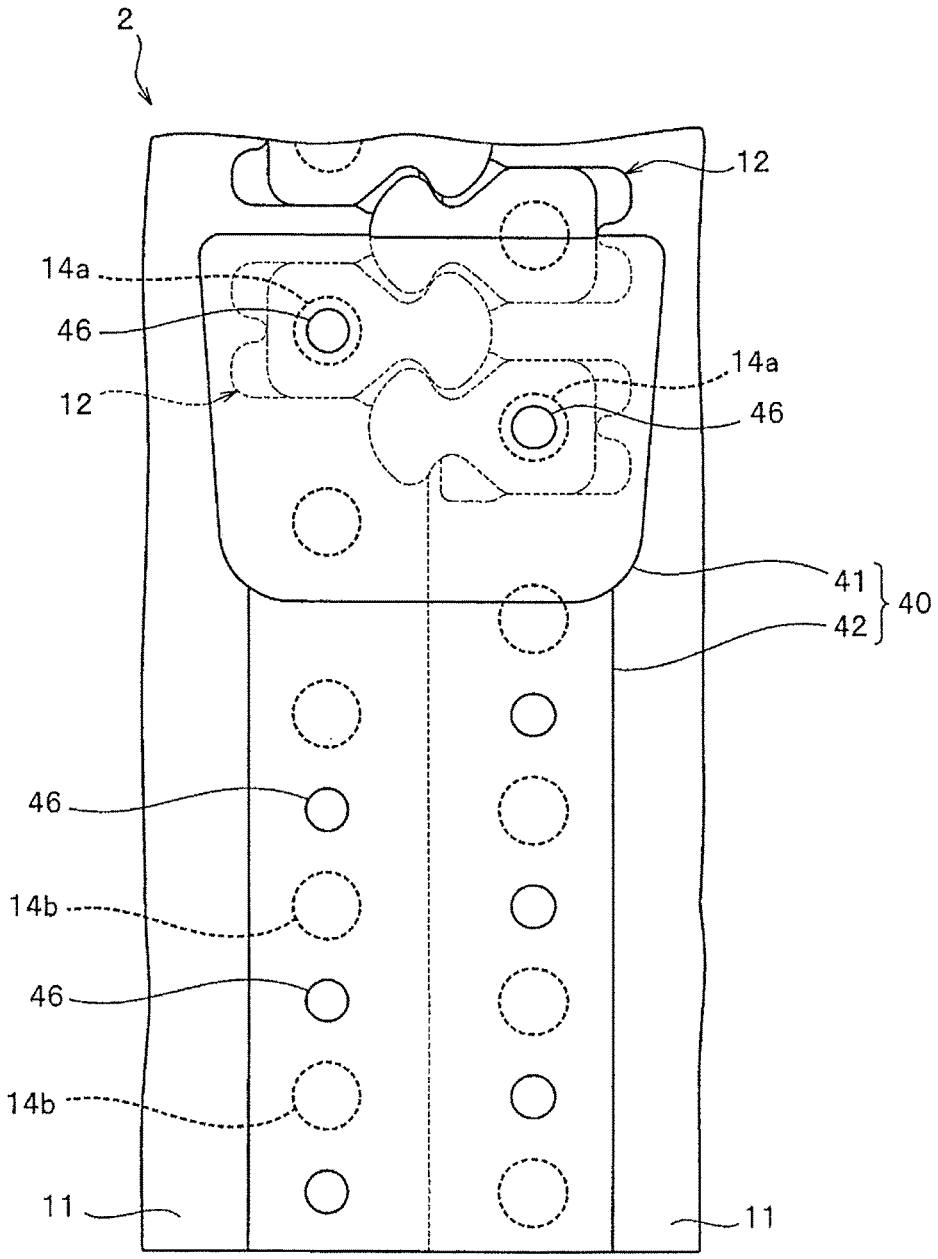
FIG. 7 is an enlarged view of main portions of a waterproof slide fastener according to a second embodiment of the invention.

FIG. 7 is an enlarged view of main portions of a waterproof slide fastener according to a second embodiment.

In the second embodiment and later-described embodiments 3 and 4, the first stopper is different from that of the first embodiment, and configurations of a waterproof slide fastener other than the first stopper are the same as those of the first embodiment.

A first stopper 40 in a waterproof slide fastener 2 of the second embodiment includes a first stopper body portion 41 and a first extension portion 42 extending downward from the first stopper body portion 41, and the first stopper body portion 41 and the first extension portion 42 straddle left and right waterproof tapes 11. Each of the first stopper body portion 41 and the first extension portion 42 includes a first half placed on a tape front surface side and a second half placed on a tape back surface side. The first and second halves are fixed to a waterproof layers 11*b* of the waterproof tapes 11, and are integrally connected to each other through a connecting portion which is drilled in a second through-hole 14*b* formed in the waterproof tape 11.

A plurality of circular recess portions 46 are formed in front and back surfaces of the first stopper body portion 41 and the first extension portion 42. In this case, each of the recess portions 46 formed in the first stopper body portion 41 is formed up to a depth at a position of a front or back surface of a fastener element 12 which is embedded in the first stopper body portion 41. Each of the recess portions 46 formed in the first extension portion 42 is formed up to a depth at a position of a front or back surface of the waterproof tape 11.

The recess portion 46 is a trace of a pin-holding formed by holding, by means of a pin, the fastener element 12 and the waterproof tape 11 which are embedded in the first stopper body portion 41 in a cavity space of a forming mold when the first stopper 40 is injection molded.

By holding the fastener element 12 and the waterproof tape 11 by means of the pin when the first stopper 40 is injection molded, it is possible to form the first stopper 40 in a state where positions of the fastener element 12 and the waterproof tape 11 are stabilized. Therefore, when the first stopper 40 is injection molded, the position of the fastener element 12 is not misaligned or the waterproof tape 11 does not flip, and the first stopper 40 can firmly be formed at a predetermined position with respect to the waterproof tape 11 and the fastener element 12. Hence, it is possible to prevent a portion of the fastener element 12 or a portion of the waterproof tape 11 from appearing from front and back surfaces of the first stopper 40, and to stably secure the fixing strength of the first stopper 40 with respect to the waterproof tape 11.

The waterproof slide fastener 2 of the second embodiment is configured in the same manner as that of the waterproof slide fastener 1 of the first embodiment except that the first stopper 40 is provided with the recess portions 46. Therefore, it is possible to obtain the same effects as those of the waterproof slide fastener 1 of the first embodiment.

Third Embodiment

Figure 8:
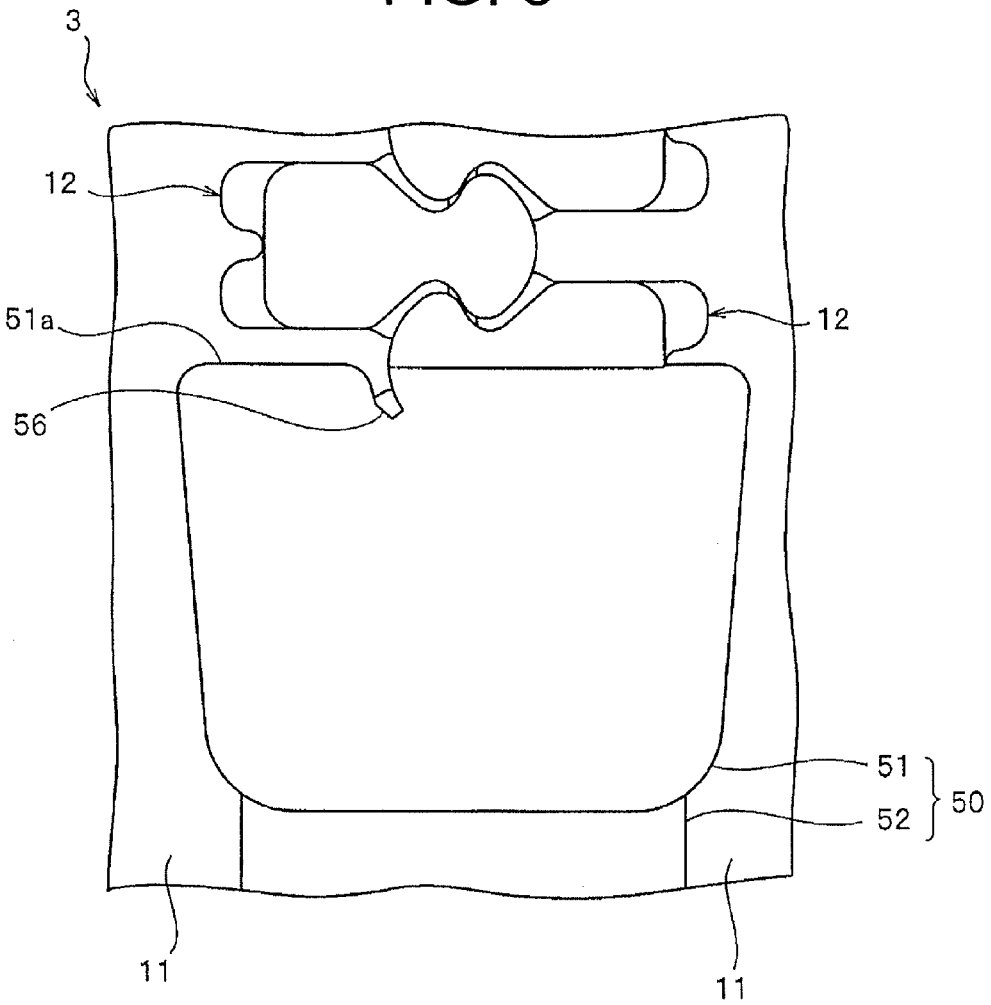
FIG. 8 is a front view showing a waterproof slide fastener according to a third embodiment of the invention.
Figure 9:
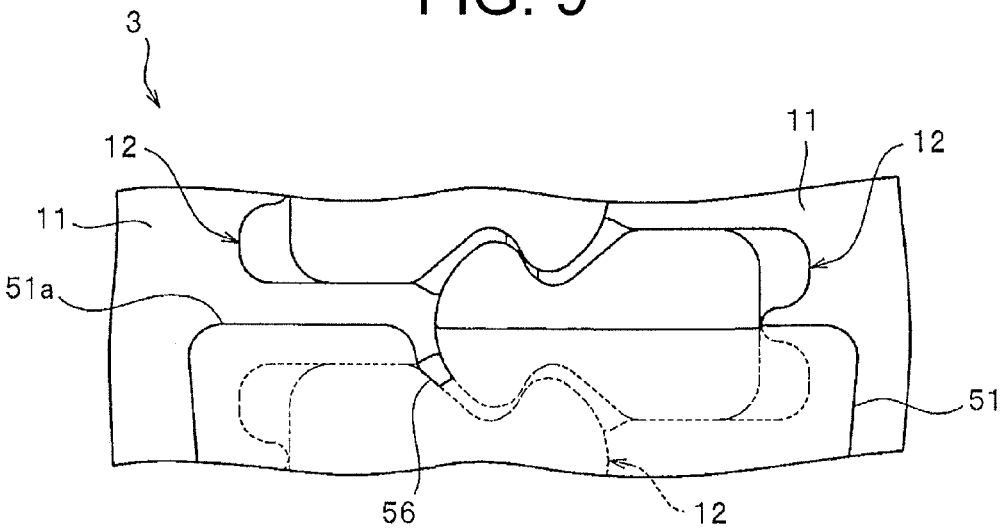
FIG. 9 is an enlarged view of main portions of the waterproof slide fastener.

FIG. 8 is a front view showing a portion of a waterproof slide fastener according to a third embodiment, and FIG. 9 is an enlarged view of main portions of the waterproof slide fastener.

A first stopper 50 in a waterproof slide fastener 3 of the third embodiment includes a first stopper body portion 51 and a first extension portion 52 extending downward from the first stopper body portion 51, and the first stopper body portion 51 and the first extension portion 52 straddle left and right waterproof tapes 11. In this case, a recess portion 56 is formed such that it is cut from an upper bottom 51*a* in first and second halves of the first stopper body portion 51 toward an extending direction (downward) of the first extension portion 52. The recess portion 56 of the first stopper body portion 51 is a trace formed by a projecting portion which projects from a cavity surface side of a mold for preventing molten resin from leaking when the first stopper 50 is injection molded.

More specifically, the fitting recess portion is recessed in a vertex of the coupling head 12*a* of the fastener element 12 as described above. Hence, when the first stopper 20 according to the first embodiment is injection molded for example, if a molding mold is fastened from tape front and back directions in the injection molding step, the fitting recess portion of the fastener element 12 having a portion which is embedded in the first stopper 20 and a portion which appears outside becomes a gap from which molten resin flows out (leaks), and there is a problem that molten resin leaks from the gap when molten resin is injected into the cavity of the mold.

To solve such a problem, in the third embodiment, a projecting portion for preventing leakage of molten resin projects from a predetermined portion of the cavity surface side in the mold for molding the first stopper 50 so that the gap from which molten resin leaks becomes small (or gap is not formed) by the fitting recess portion of the fastener element 12. As shown in FIG. 9, it is preferable that the projecting portion for preventing leakage of molten resin is in contact with a front surface of a shoulder 12*d* of the fastener element 12. By suppressing leakage of molten resin when the first stopper 50 is injection molded in this manner, since the first stopper 50 having a predetermined shape is stably formed, visual quality and quality of appearance of the waterproof slide fastener 3 are excellent.

Fourth Embodiment

Figure 10:
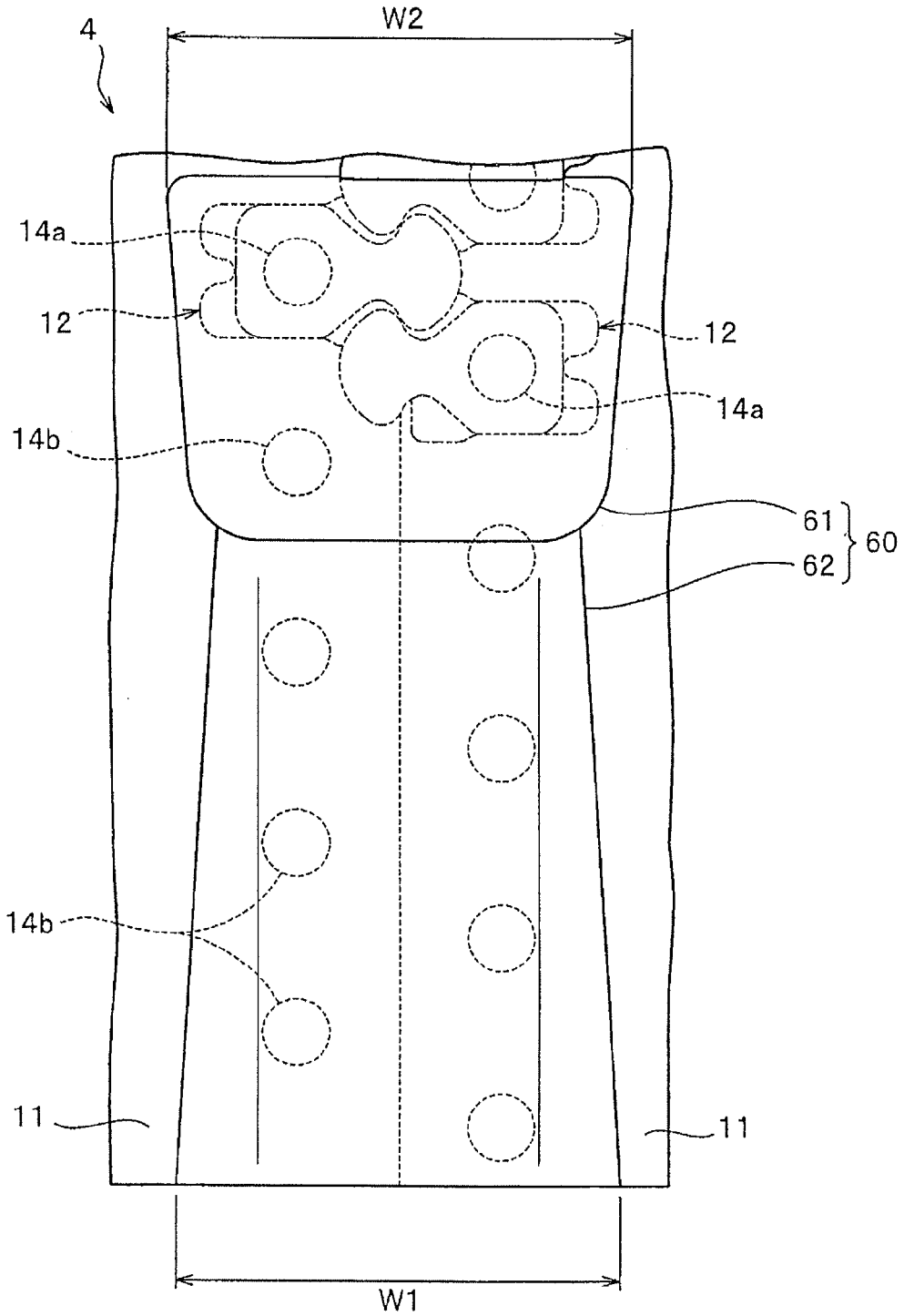
FIG. 10 is a front view showing a waterproof slide fastener according to a fourth embodiment of the invention.
Figure 11:
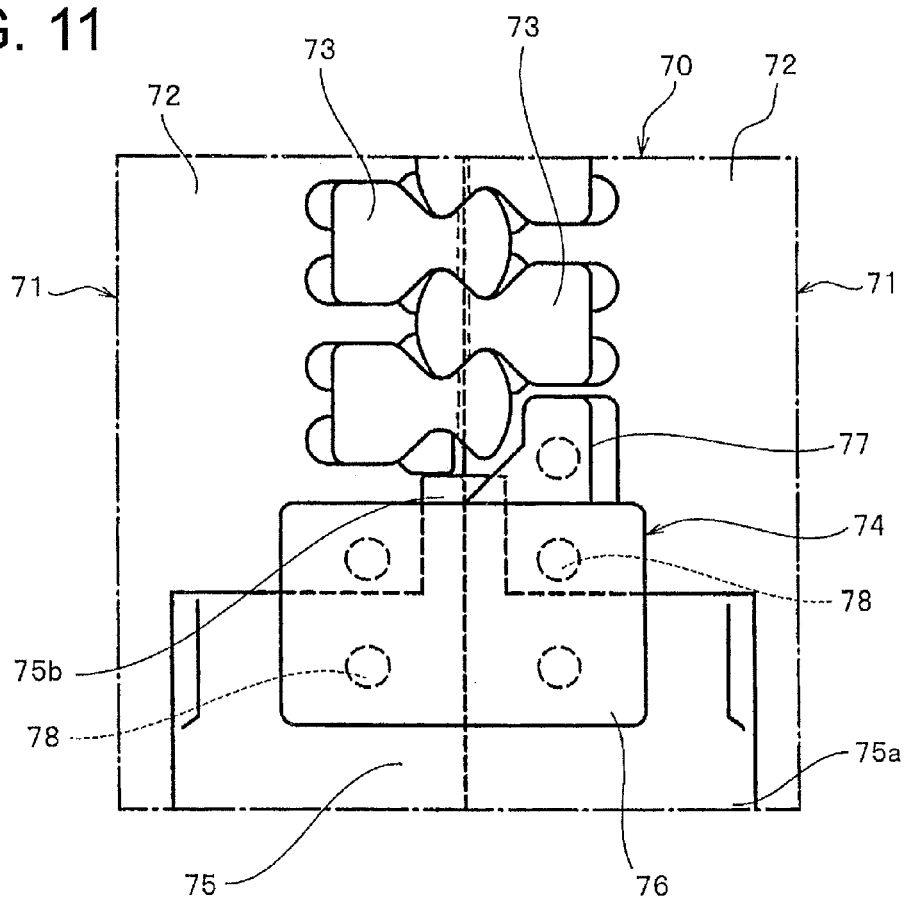
FIG. 11 is a front view showing a conventional waterproof slide fastener.
Figure 12:
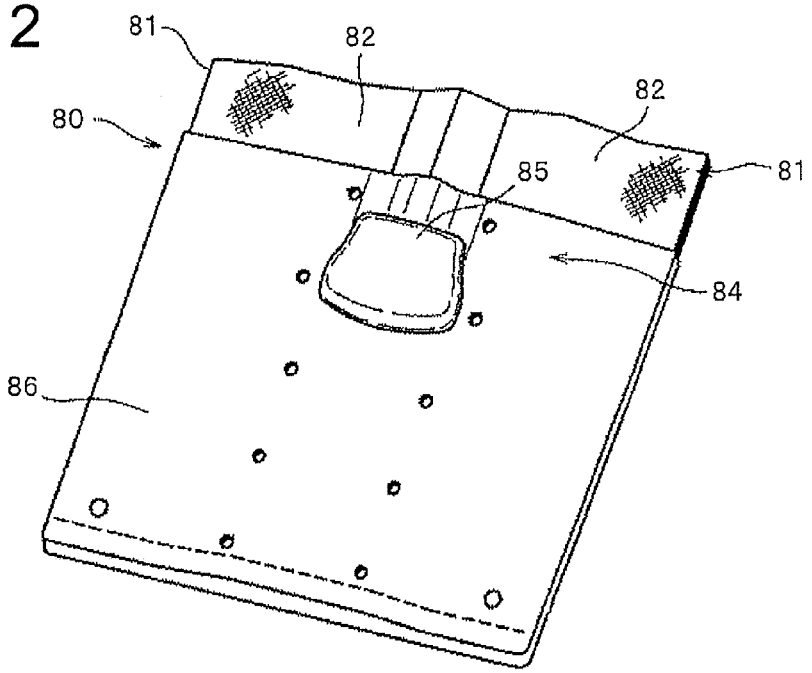
FIG. 12 is a front side perspective view showing another conventional waterproof slide fastener.
Figure 13:
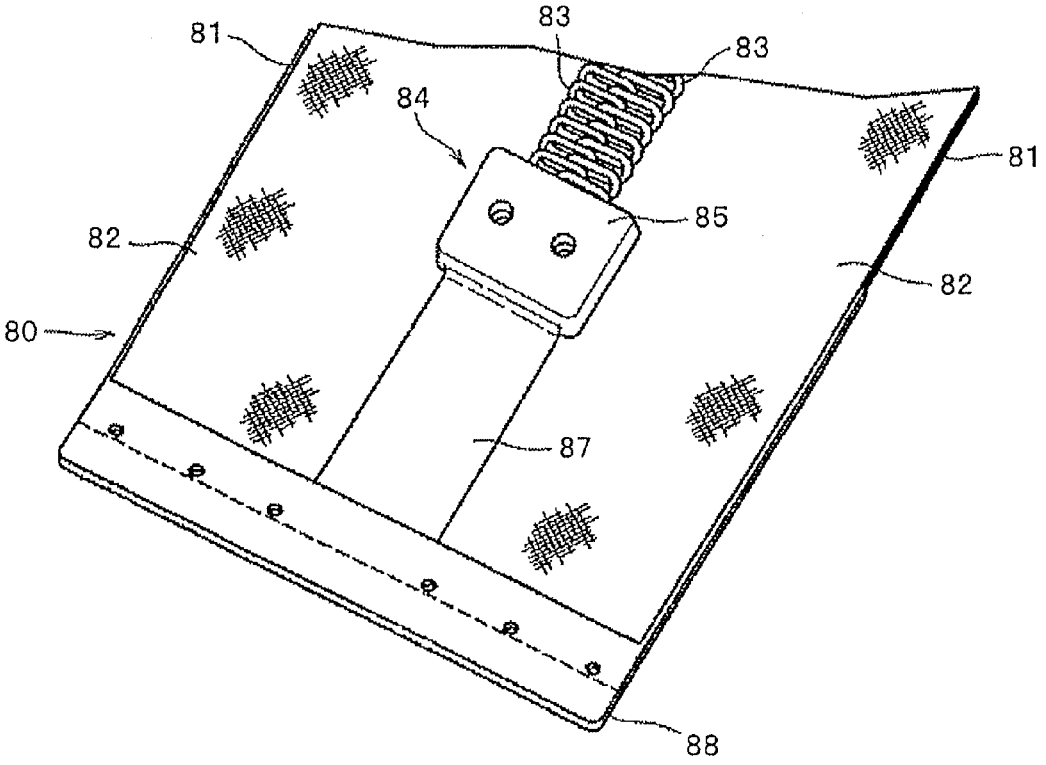
FIG. 13 is a back side perspective view of the waterproof slide fastener.
Figure 14:
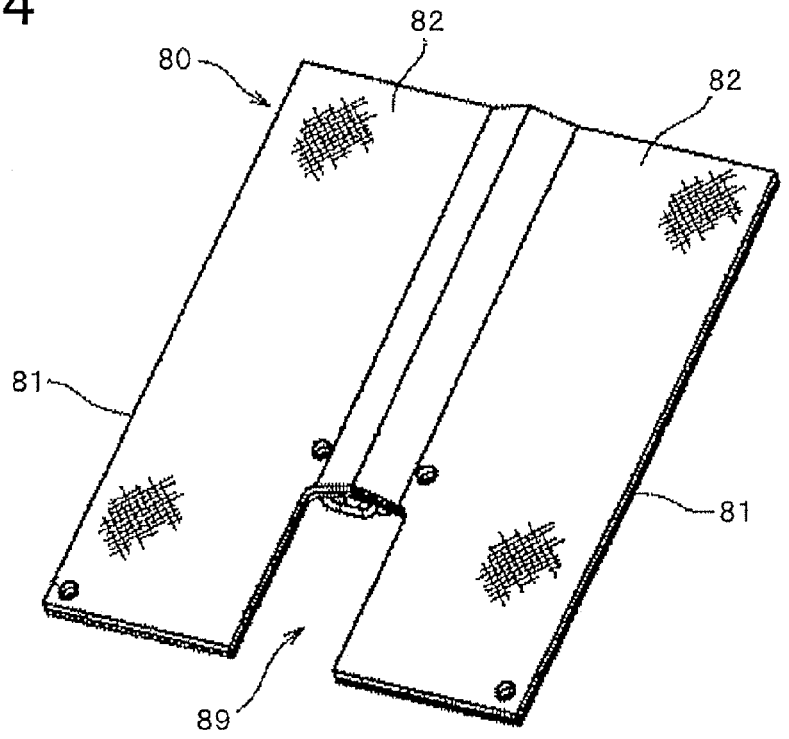
FIG. 14 is an explanatory diagram showing a state before a first stopper of the waterproof slide fastener is formed.

FIG. 10 is a front view showing a portion of a waterproof slide fastener according to a fourth embodiment.

A first stopper 60 in the waterproof slide fastener 4 of the fourth embodiment includes a first stopper body portion 61 and a first extension portion 62 extending downward from the first stopper body portion 61, and the first stopper body portion 61 and the first extension portion 62 straddle left and right waterproof tapes 11. In this case, the first stopper body portion 61 of the fourth embodiment is configured in the same manner as that of the first stopper body portion 21 in the first embodiment.

The first extension portion 62 of the fourth embodiment is formed from the first stopper body portion 61 toward a lower end edge of the waterproof tape 11 along a tape length direction. A first half placed on a tape front surface side and a second half placed on a tape back surface side of the first extension portion 62 are fixed to waterproof layers 11*b* of the waterproof tapes 11 respectively, and integrally connected to each other through a connecting portion drilled in a second through-hole 14*b* formed in the waterproof tape 11.

Outer surfaces of left and right side edge portions of the first and second halves of the first extension portion 62 are curved so that a thickness dimension of the first extension portion 62 is gradually reduced outward in a tape width direction. Further, a width dimension of the first extension portion 62 is gradually increased toward a lower end edge of the waterproof tape 11, and width dimensions of left and right side edge portions whose outer surfaces are curved are gradually increased downward. In this case, a width dimension W1 of a widest lower end edge of the first extension portion 62 is set smaller than a width dimension W2 of a widest portion (portion close to upper bottom) of the first stopper body portion 61.

The width dimension of the first extension portion 62 of the fourth embodiment is gradually increased downward as described above. Therefore, the more the first extension portion 62 separates from the first stopper body portion 61, the smoother the outer surfaces of both the side edge portions of the extension portion become (inclination becomes more gentle). Hence, when a waterproof slide fastener 4 of the fourth embodiment is adhered to or welded onto a fastener-attached product 6, it becomes more difficult to form a gap between the waterproof slide fastener 4 and the fastener-attached product 6, and it is possible to more stably prevent water from entering the waterproof slide fastener 4 from this gap.

DESCRIPTION OF REFERENCE NUMERALS

1, 2, 3, 4 waterproof slide fastener
6 fastener-attached product
6*a* opening
7 adhesive tape
8 slider
8*a* slider body
10 fastener stringer
11 waterproof tape
11*a* fastener tape
11*b* waterproof layer
12 fastener element
12*a* coupling head
12*b* neck
12*c* barrel
12*d* shoulder
12*e* leg
13 element row
14*a* first through-hole
14*b* second through-hole
15 first element half (front surface side element half)
16 second element half (back surface side element half)
17 connecting portion
20 first stopper (lower stopper)
21 first stopper body portion
21*a* upper bottom
21*b* lower bottom
21*c* side
22 first extension portion
23 first half (front surface side half)
24 second half (back surface side half)
25 connecting portion
30 second stopper (upper stopper)
31 second stopper body portion
31*a* slider contacting portion
31*b* slider insertion portion
31*c* ridge portion
31*d* accommodating portion
31*e* tip end
32 second extension portion
40 first stopper
41 first stopper body portion
42 first extension portion
46 recess portion
50 first stopper
51 first stopper body portion
51*a* upper bottom
52 first extension portion
56 recess portion
60 first stopper
61 first stopper body portion
62 first extension portion
W1, W2 width dimension

The invention claimed is:

1. A waterproof slide fastener including:

a pair of fastener stringers in which a plurality of synthetic resin fastener elements is injection molded on opposed tape side edge portions of a pair of waterproof tapes provided at least one of tape surfaces with a waterproof layer;

a slider slidably attached to an element row including the plurality of fastener elements; and a synthetic resin stopper placed on at least one of ends of the element row, in which the fastener elements includes a first element half placed on a first tape surface side of the waterproof tape and a second element half placed on a second tape surface side of the waterproof tape, and the first and second element halves are integrally connected to each other through first through-holes which are drilled in the tape side edge portion at predetermined intervals from each other, wherein each of the waterproof tapes includes at least one second through-hole drilled in a forming region of the stopper at the same intervals as those of the first through-holes, the stopper includes a body portion with which the slider comes into contact to stop the slider, and an extension portion extending from the body portion in a direction opposite from the element row along a tape length direction, the body portion and the extension portion are integrally molded with each other by injection molding, the body portion and the extension portion include a first half placed on the first tape surface side and a second half placed on the second tape surface side, the body portion and the extension portion are fixed such that the first half and the second half straddle the pair of waterproof tapes, and the first half and the second half are integrally connected to each other through the second through-hole, a thickness dimension of the extension portion is smaller than that of the body portion, the body portion and the extension portion are formed to hold the tape side edge portions of the waterproof tape, and the extension portion is formed up to an end edge of the waterproof tape.

2. The waterproof slide fastener according to claim 1, wherein a width dimension of the extension portion on the first tape surface side and the second tape surface side is set smaller than that of the body portion.

3. The waterproof slide fastener according to claim 1, wherein outer surfaces of both the side edge portions of the extension portion are formed into curved surfaces so that a thickness dimension of the extension portion is gradually reduced outward in a tape width direction.

4. The waterproof slide fastener according to claim 1, wherein a width of the extension portion is gradually increased toward an end edge of the waterproof tape.

5. The waterproof slide fastener according to claim 1, wherein the stopper is fixed to both ends of the element row.

6. The waterproof slide fastener according to claim 1, wherein the stopper is placed on an end of the element row on a side where the slider slides such that the element row closes, the body portion includes a slider insertion portion inserted into an element guide path of the slider, and the slider insertion portion includes a ridge portion which comes into intimate contact with inner surfaces of upper and lower blades of the slider.

7. The waterproof slide fastener according to claim 1, wherein the stopper is placed on an end of the element row on a side where the slider slides such that the element row separates, and a portion of the fastener element is embedded in the body portion.

8. The waterproof slide fastener according to claim 7, wherein a recess portion is formed in the body portion of the stopper such that the recess portion is cut from an upper bottom of the body portion in an extending direction of the extension portion.

* * * * *